US005077949A

United States Patent [19]

Kotter

[11] Patent Number: 5,077,949

[45] Date of Patent: Jan. 7, 1992

[54] ADAPTIVE ARCHITECTURAL COVER PANELS

[76] Inventor: Rodman W. Kotter, 10815 Molony Rd., Culver City, Calif. 90230

[21] Appl. No.: 586,793

[22] Filed: Sep. 24, 1990

Related U.S. Application Data

[60] Continuation-in-part of Ser. No. 355,788, May 19, 1989, Pat. No. 4,958,476, which is a division of Ser. No. 174,516, Mar. 28, 1988, abandoned.

[51] Int. Cl.[5] ..... E04C 3/34; E04G 21/14

[52] U.S. Cl. ..... 52/506; 52/630; 52/724; 52/732; 52/745; 29/453

[58] Field of Search ..... 52/DIG. 10, 81, 82, 52/18, 326, 577, 630, 450, 745, 732, 724, 80, 506; 446/488; 29/453

[56] References Cited

U.S. PATENT DOCUMENTS

| | | | |
|---|---|---|---|
| 1,231,348 | 6/1917 | Hernandez | 52/577 |
| 2,164,966 | 7/1939 | Tutein | 446/488 |
| 2,792,164 | 5/1957 | Cauffiel | 52/792 |
| 3,346,998 | 10/1967 | Nelson | 52/81 |
| 3,444,558 | 5/1969 | Leitner | 52/630 |
| 3,524,288 | 8/1970 | Coppa | 52/81 |
| 3,557,501 | 1/1971 | Kolozsvary | 52/81 |

FOREIGN PATENT DOCUMENTS

| | | | |
|---|---|---|---|
| 360935 | 7/1938 | Italy | 52/82 |
| 509434 | 7/1939 | United Kingdom | 493/295 |

*Primary Examiner*—James L. Ridgill, Jr.
*Attorney, Agent, or Firm*—Pretty, Schroeder, Brueggemann & Clark

[57] ABSTRACT

An architectural cover panel system of individually adaptive panels for covering structural support members of an underlying structure such as girders. An individual adaptive panel includes a sheet of flexible material having a generally convex cross-section and is provided with corrugations oriented perpendicular to the longitudinal axis of the panel. In one preferred embodiment the convex panel is provided with edge portions attached to the lateral sides of the panel. The edge portions are similarly provided with corrugations oriented parallel to and intersecting or merging into the corrugations of the convex panel portion. In other embodiments of the invention, panels having radial corrugations are used allowing the panels to respond to dimensional changes due to temperature effects and to resist wind forces without deforming the shape of the overall structure, and panels with diagonal corrugations provide bidirectional flexibility.

9 Claims, 5 Drawing Sheets

FIG. 1.
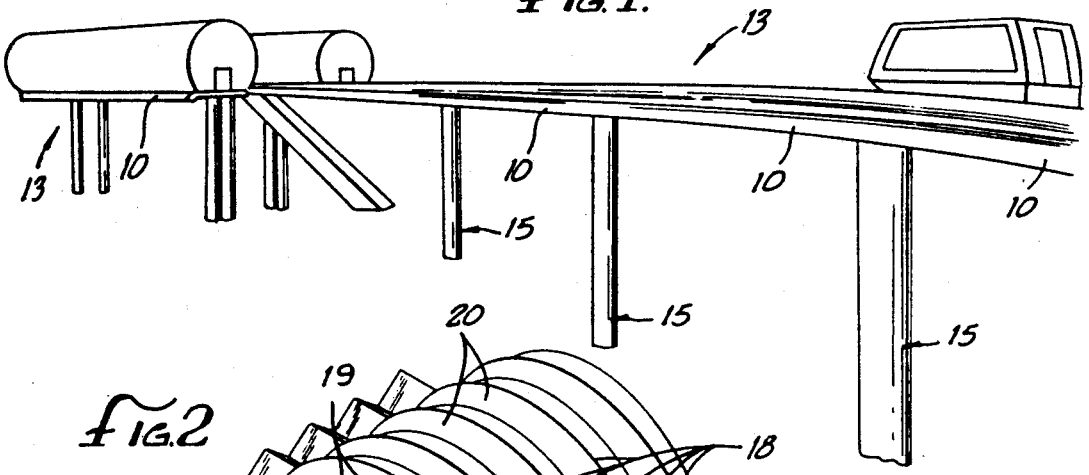
FIG. 2
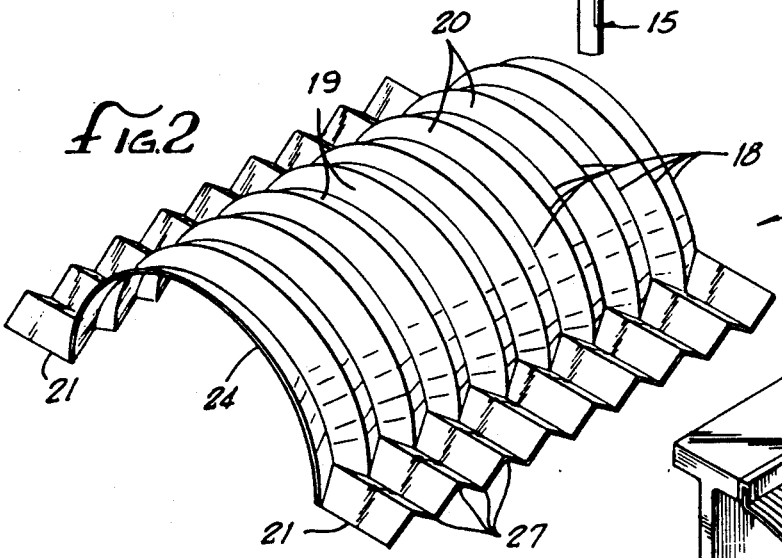
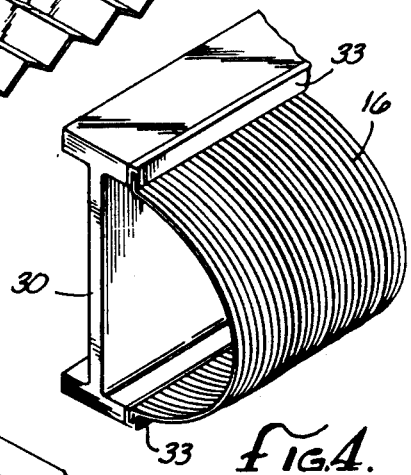
FIG. 4.
FIG. 3.
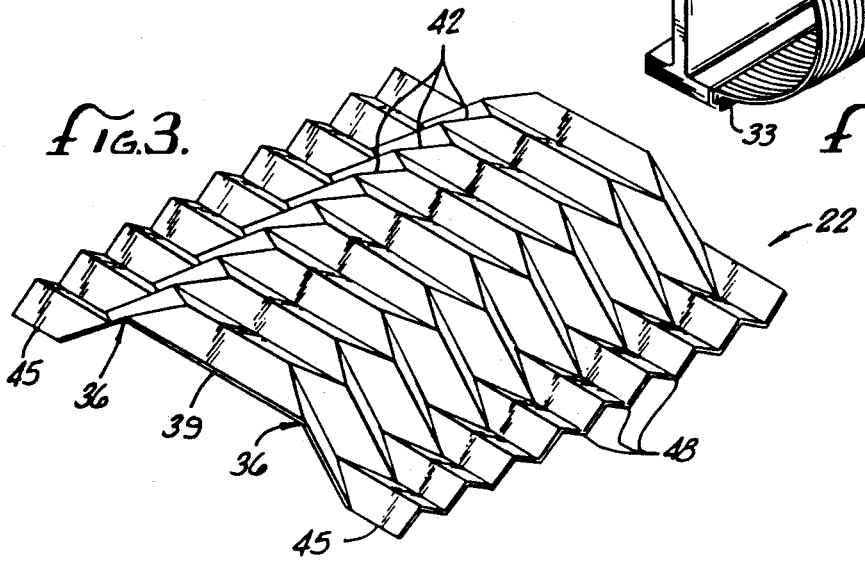

FIG. 5.
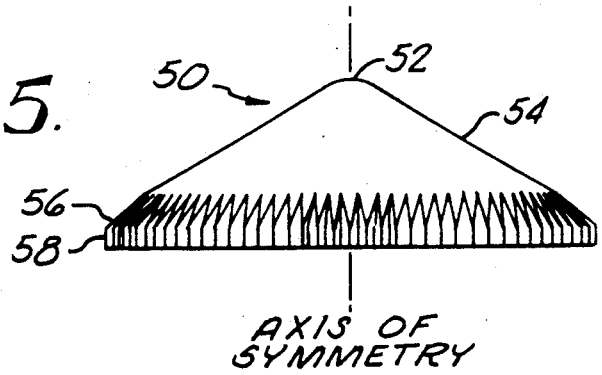
FIG. 6.
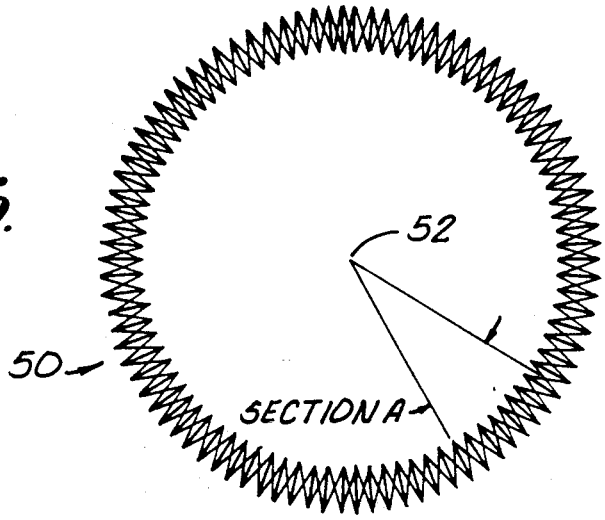
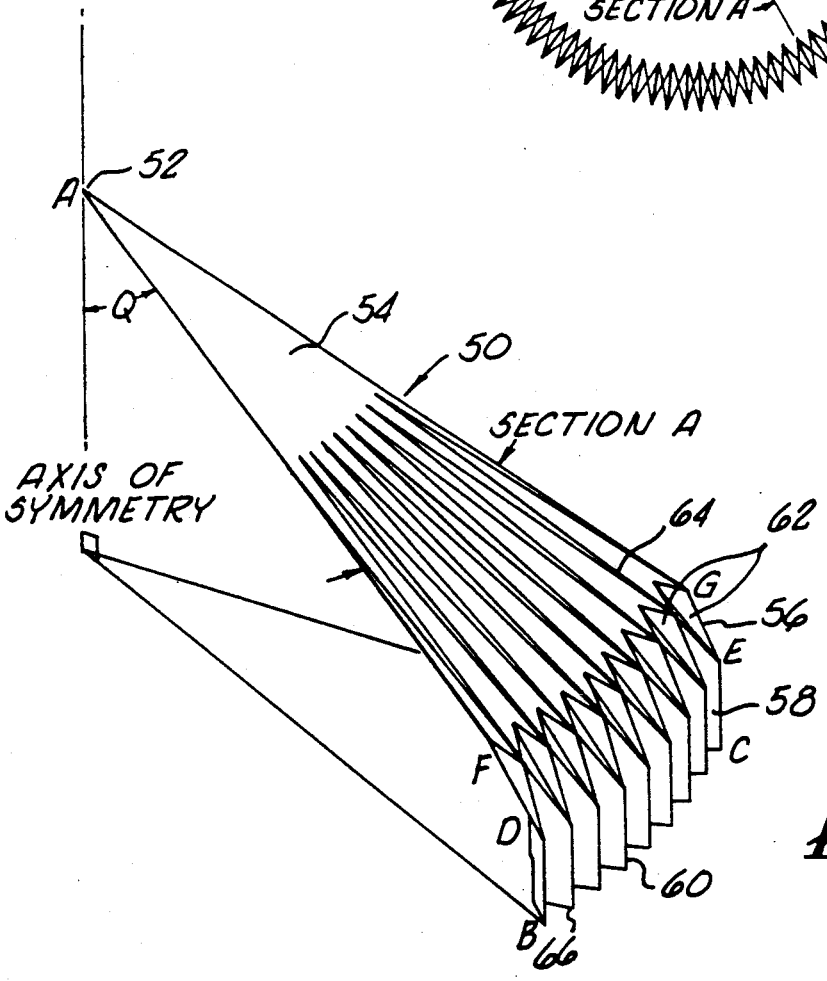
FIG. 7.

ADAPTIVE ARCHITECTURAL COVER PANELS

This is a continuation-in-part of application Ser. No. 07/355,788, filed May 19, 1989, now U.S. Pat. No. 4,958,476 which is a divisional of application Ser. No. 07/174,516 filed Mar. 28, 1988, now abandoned.

BACKGROUND OF THE INVENTION

The present invention concerns architectural structures, and more particularly, relates to an architectural cover panel system for covering structural support members. Architectural cover panels are typically employed to provide aesthetically pleasing coverings over structural support members such as bridge girders, building columns, and beam members, such as I-beams. These cover panels also provide some protection to the structural support member from the elements and may otherwise serve to seal the underlying support structure from intrusions, such as for example bird nestings.

Conventional architectural cover panels are generally configured as flat sheets of relatively thick material which are attached to an exposed side of a structural support member. One example of a conventional architectural cover panel is illustrated in U.S. Pat. No. 3,538,664 to L. Frandsen et al. Because of their generally planar configuration, conventional architectural cover panels require significant rigidity and strength to resist wind loading forces which could otherwise deform, dismember or dislodge the panel. Accordingly, conventional cover panels can add significant weight to the entire load supported by the underlying structural member. Fitting conventional architectural cover panels to a structural support member can also be an expensive, labor and time intensive effort since the panels have to be cut and trimmed in order to fit a variety of complex curves and shapes of the structural support member. Thus there still exists a need for a light-weight architectural cover panel which is adaptable to the varying dimensions and shapes of differing structural support members but adequately resistant to wind loading forces.

SUMMARY OF THE INVENTION

Briefly, and in general terms, the present invention provides a light-weight architectural cover panel system which is both resistant to wind loading forces and also readily adaptable to structural support members having a variety of dimensions and surface shapes without excessive trimming or cutting of individual panels.

More specifically, the present invention resides in a system of adaptive architectural cover panels made from relatively thin sheet material and formed in a generally convex cross-sectional shape, whether of curved or angular configuration or otherwise. The panels are provided with corrugations lying in the cross-sectional plane, allowing the panel the flexibility to either expand or contract along any desired axis so as to conform to the shape of a structural support member while further providing significant reinforcement against wind loading forces. Adjacent panels may be overlapped or nested at their ends with the result that a plurality of panels can be efficiently and economically joined contiguously to attractively and uniformly cover the full extent of a complexly shaped structure.

In one preferred embodiment of the architectural cover panel system of the present invention, the individual panels further may be provided with edge portions projecting from the longitudinal margins or sides of the convex portion of the panels. The edge portions also may be corrugated, with these corrugations lying generally parallel to and intersecting the corrugations of the convex panel portion. The edge portions provide a simple method of attaching the panel to a structural support member and further provide additional resistance to wind loading forces.

In another embodiment of the invention, a cover panel is formed with radial corrugations, allowing the panel to be formed into various geometric configurations such as a dome, which can respond to fluctuations in temperature or wind forces without changing the overall shape of the cover. This has particular advantages in applications where it is important to maintain the alignment and configuration of the cover, relative to an axis of symmetry, as for example where the cover is for an antenna the operation of which would be adversely affected by changes in the cover configuration.

In yet another embodiment of the invention, the panels have corrugations which are diagonal relative to the edges of the panel. This type of corrugation pattern allows the panel to deform along two dimensions. These bidirectional panels may also have corrugations along their edge portions to allow flexibility therealong. In a further aspect of the invention panels having corrugated body portions that are raised relative to corrugated edge portions can be combined back-to-back with other like panels to form brick-like structures that provides both sound and heat insulating properties.

The novel features which are believed to be characteristic of the present invention, together with further objectives and advantages thereof, will be better understood from the following detailed description considered in connection with the accompanying drawings, wherein like numbers designate like elements. It should be expressly understood, however, that the drawings are for purposes of illustration and description only and are not intended as a definition of the limits of the invention.

BRIEF DESCRIPTION OF THE DRAWINGS

FIG. 1 is a perspective view of the adaptive architectural cover panel system of the present invention installed over an illustrative architectural structure;

FIG. 2 is a perspective view of one preferred embodiment of an individual adaptive architectural cover panel of the present invention;

FIG. 3 is a perspective view of yet another preferred embodiment of an individual adaptive architectural of the present invention;

FIG. 4 is a perspective view of the individual architectural panel illustrated in FIG. 2 attached to an exemplary structural support member.

FIG. 5 is a side view of yet another embodiment of the present invention adapted to be a one piece cover for a microwave antenna;

FIG. 6 is a top view of the cover in FIG. 5;

FIG. 7 is a perspective view of a section of the cover in FIG. 5;

DETAILED DESCRIPTION OF THE INVENTION

Figure 9B:
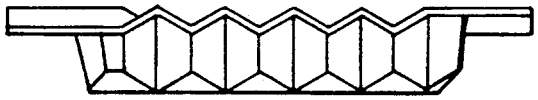
FIG. 9*b* is a rear view of the panel in FIG. 8.

Referring to the figures, and more particularly FIG. 1 thereof, there is shown an illustrative application of the present inventive adaptive architectural panel system 10 covering the edges of structural support members 13 forming a monorail track and monorail station platform structure. The ends of adjacent panels 10 may be overlapped and nested to obscure the junctures of the panels and provide a cleaner, more aesthetically appealing architectural appearance to the underlying support members. Although relatively light, and therefore adding little to the total structural weight load born by the structural support member 13, the panels 10 are still sufficiently strong to resist high wind loading.

One preferred embodiment of an individual panel 16 that forms part of the panel system 10 is more fully illustrated in FIG. 2. As shown, the panel 16 is made from a square or generally rectangular sheet of relatively thin material and is formed into a panel having a generally convex cross-section. The panel 16 is also provided with a plurality of corrugations 18, oriented perpendicular to a longitudinal axis of the panel and parallel to the plane of the panel crosssection. The corrugations 18 add enhanced flexibility to the panel 16 while simultaneously providing additional structural reinforcement. The configurations illustrated in FIG. 2 characterize only one type of fold pattern contemplated by the present invention. As illustrated, the corrugations of the panel 16 provide generally flat surfaces 19 meeting at varying angles with alternating surfaces 20 lying in essentially parallel planes. Other corrugation patterns could also be used such as, for example, where the alternating flat surfaces 20 would lie in non-parallel planes and every third flat surface would lie in a parallel plane.

The corrugations permit expansion or contraction along the entire width and length of the panel 16 to accommodate support members 13 of varying dimensions, and further allow for localized panel expansion or contraction so as to conform the panel 16 to the surface curvature of the support member 13. Thus, the corrugations allow the same adaptive cover panel 16 to be used in conjunction with several different types of structural support members of varying dimensions and surface shapes without the need for excessive cutting or trimming. At the same time, however, the corrugations further permit use of lighter materials, such as sheet metals, plastics or composite materials, for the construction of the panel 16 while still retaining sufficient rigidity to resist wind loading. The corrugations 18 also facilitate the overlapping placement of adjacent panels 16 so as to obscure the junction of the panels 16 and provide cleaner architectural lines as discussed above. Differences in the thermal expansion coefficients of the panels 16 and support members 13 are also accommodated by the adaptive expansion and contraction of the panels 16.

In the preferred embodiment illustrated in FIG. 2, the panel 16 is further provided with edge portions 21 projecting from the longitudinal sides of the convex body portion 24. The edge portions 21 are also provided with corrugations 27 which are oriented perpendicular to the longitudinal axis of the panel and thus lie parallel to and intersect with or merge into the corrugations 18 of the convex body portion 24 in an "intercorrugated" manner as shown in FIG. 2, whereby the corrugations 27 of the edge portions 21 are formed reversely to the corrugations 18 of the convex body portion 24. Because of the intercorrugation pattern tension or compression stresses created in the individual surfaces forming the pattern, caused by bending the panel to cover architectural curvatures or due to thermal effects, are translated into forces which rotate about the apex of the angeles between the corrugated surfaces. This facilitates desirable flexure of the panel while continuing to provide high strength to normal forces, such as wind loading. Additionally, these edge portions 21 permit the adaptive panels 16 to be very easily mounted on to a structural support member while maintaining the adaptive character of the panel 16 and adding to its wind loading resistance.

As illustrated in FIG. 4, this preferred embodiment of the panel 16 may be mounted onto an illustrative structural support member 30 by attaching channel members 33 onto the opposing edges of the support member 30. The edge portions 21 of the panel 10 may then be affixed within the channels 33 by any convenient means such as, for example, screws, rivets or other mechanical fasteners. It should be understood that for the purposes of the present invention, however, the panel 16 could also be directly attached to the structural support member 30.

The present inventive adaptive architectural cover panel need not be restricted to convex configurations which are generally curved in crosssection such as the panel 16 shown in FIG. 2. By way of illustration, another preferred embodiment of an individual adaptive panel 22 of the present invention is further shown in FIG. 3. In this embodiment the panel 22 has a convex configuration which is generally truncated triangular in cross-section with the internal intersections 36 of the body portion 39 forming angles generally exceeding ninety degrees. The body portion 39 is also provided with corrugations 42 generally oriented perpendicular to the longitudinal axis of the panel 22 and generally parallel to the cross-sectional plane of the panel 22. As shown in FIG. 3, the lateral sides of the truncated triangular cross-section can be intercorrugated with the top of the body portion 39. This embodiment may further, but need not necessarily, be provided with edge portions 45 attached to the lateral sides of the body portion 39 forming further corrugations 48 oriented parallel to and intersecting or merging with the corrugations 42 of the body portion 39 in an intercorrugated manner as shown in FIG. 3. As with the embodiment discussed above in connection with FIG. 2, the panel 22 of this embodiment can similarly be expanded and contracted along its entire length or width to adapt the panel 22 to structural support members of varying dimensions without specialized tailoring. Additionally, localized expansion and contraction of the corrugations 42 and 48 permit curvature of the panel 22 so as to adapt to the complex surface curvatures of various structural support members.

The panels described above are "unidirectional" panels because they are able to change shape along essentially a single axis. In many applications the unidirectional panel provides sufficient flexibility, however, there also is a need for panels which are able to change shape in two directions. Examples of such "bidirectional" panels are illustrated in FIGS. 5 through 10.

FIGS. 5–7 illustrate one type of bidirectional panel containing intercorrugations of the same general type as described above. More particularly the cover panel is in the configuration of a conical type surface, suitable for a roof structure or other application. In the specific case of FIG. 5 the dome is in intended as a cover for a microwave antenna installation. In FIG. 5 there is shown a cover 50 having a center 52 from which a body portion 54 extends radially downward. At the outer diameter of the body there is edge 56 which extends to the side 58.

Referring to FIG. 7, cover 50 has a side portion 58 with side corrugations 60. The cover has edge portion 56 with edge corrugations 62, and a body portion 54 with body corrugations 64. The body, edge and side corrugations allow the cover to flex and accommodate expansion and contraction due to thermal effects and avoid disturbing the original orientation, the axis of symmetry or the overall dimensions of the cover 50. Desirable results are obtained when the orientation and the axis of symmetry of the cover do not change. The cover can be more firmly mounted to a structure (not shown) through the side corrugations 58 and minimize the risk of the cover geometry being disturbed by any means. In some applications, such as microwave antenna covers, the need to retain the overall dimensions and alignment of the cover is very important in order to assure good performance of the antenna. Microwave antennas frequently are adapted to have a bore sight alignment to another microwave antenna at a distance, but at a line-of-sight location. Small changes in the antenna cover geometry can cause undesirable refractive effects which disturb the bore sight alignment between the antennas and degrade the performance of the antennas.

In the preferred embodiment illustrated in FIG. 7 the side corrugations 60 are oriented perpendicular to the circumference of the cover 50. These corrugations allow the cover to expand and contract along the circumference without disturbing the axis of symmetry of the cover and thus the effective alignment of the antenna. The side portion has base portion 66 which can be mounted in a ring type channel attached to the antenna structure (not shown) and can be mechanically attached to the antenna mounting channel with screws, bolts or rivets. In the embodiment illustrated in FIGS. 5 and 7 the side portion 58 is perpendicular to the plane containing the circumference of the cover, however it can be offset at an angle if desired.

The edge portion 56 has edge corrugations 60 which are triangularly shaped in the embodiment illustrated in FIG. 7. The edge portion is at an angle less than perpendicular to the circumference of the cover. The edge corrugations allow the cover to deform along its edge due to the effects of heat without disturbing the axis of symmetry of the cover and the shape of the cover edge 16.

The body portion 54 has body corrugations 64 extending from the edge portion 56 radially inward. In the preferred embodiment illustrated in FIG. 7 body corrugations do not extend to the panel center 52. The body portion is at an angle less than perpendicular to the circumference of the cover. In the preferred embodiment illustrated in FIGS. 5 and 7 the body portion is oriented at an angle less than the edge portion is oriented. Body corrugations 64 allow the body portion to deform along its circumference without affecting the overall shape of the panel 50.

The cover uses the innovative intercorrugation structure to retain strength while minimizing weight. The body corrugations 64 are intercorrugated with the edge corrugations. In turn, the edge corrugations are intercorrugated with the side corrugations. This intercorrugation adds to the mechanical strength and function of the cover and as a flexing mechanism that responds uniformly around the periphery of the panel to compensate for thermal effects on the cover and preserve the geometry and axis of symmetry of the cover.

The ability of the panel system of the present invention to adapt to deformations is best understood by studying the deformation of a portion of the cover as illustrated in FIG. 7. In FIG. 7 various points along the panel are defined by the letters A, B, C, D, E, F and G. The body corrugations 64 allow the body portion 54 to expand and contract circumferentially without affecting the boundaries marked by the triangle AFG, or disturbing an angle "Q" formed by the body and the axis of symmetry of the cover. The side corrugations 60 allow the side portion 58 to expand and contract circumferentially without affecting the boundaries of the rectangle BCED. The edge corrugations 62 serve two functions. The first function is to allow the edge portion 56 to expand and contract along the circumferences DE and FG without affecting the outer dimensions of the area DEGF. The second function is to allow the edge portion to expand and contract along radii FD and GE without affecting the overall shape of the area DEGF. The radial deformations can be caused by radial deformations of body portion 54 or deformations of side portion 58 along the axis perpendicular to the circumference of the cover 50. Thus it can be seen that the body edge and side portions can all deform without affecting the overall shape of the boundary AFD-BCEG. In this way the inventive panel system is able to reduce the affects that heat and wind can have on the performance of the microwave antenna.

Figure 8:
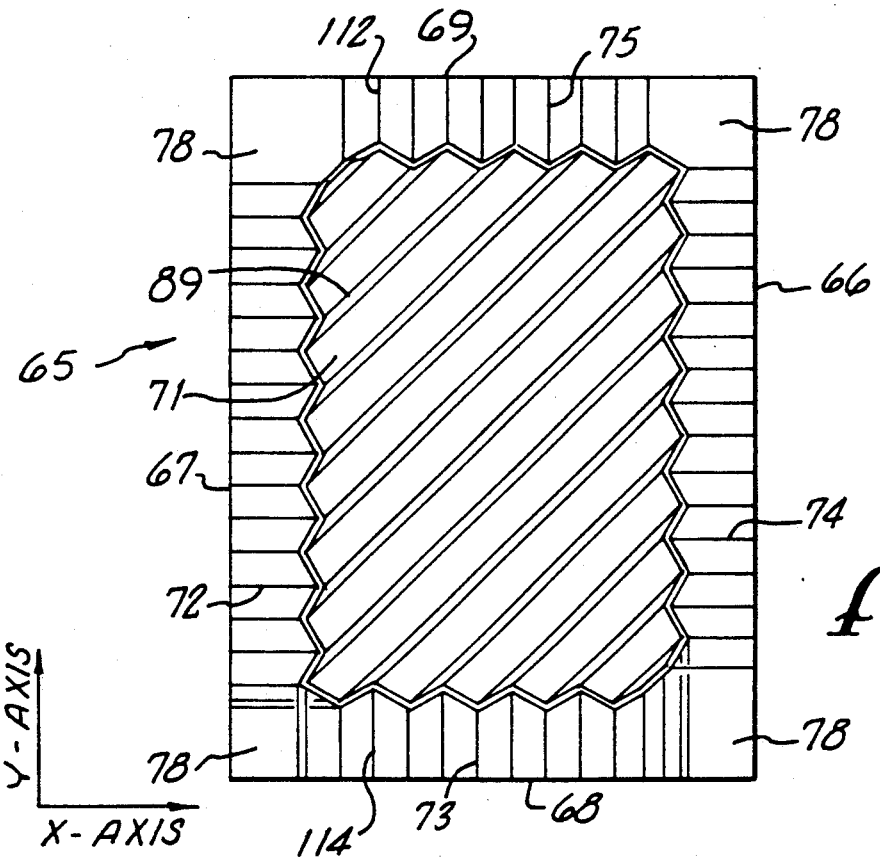
FIG. 8 is a top view of a bidirectional panel embodying the present invention.
Figure 9A:
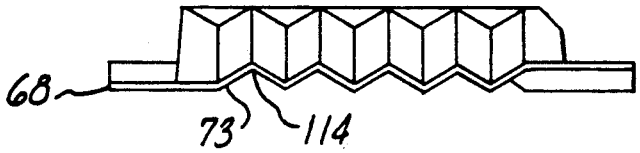
FIG. 9*a* is a front view of the panel in FIG. 8.

Referring to FIGS. 8 and 9, another type of bidirectional panel is illustrated. The bidirectional panel 65 is distinguished from the unidirectional panels of FIGS. 2–4 in part by the fact that the bidirectional panel includes edge portions 66, 67, 68 and 69 bounding the entire periphery of a body portion 71. In other words, as illustrated in FIG. 8, there are edge portions on each side of the body portion, unlike the panels illustrated in FIGS. 2, 3 and 4. The edge portions have corrugations 72, 73, 74 and 75. Edge corrugations 73 and 75 are asymmetrical to each other; that is, where the edge corrugation 73 is at a peak 114, the corresponding edge corrugation 75 is at a valley 112. Similarly, edge corrugations 72 and 74 are asymmetrical, which has advantages that will become apparent in connection with FIG. 11 discussed below. The body portion 71 of the bidirectional panel 65 has corrugations 89 that are formed diagonally to the edge portions 66, 67, 68 and 69.

Because the body corrugations are diagonal, increased flexibility of the body portion in both the X- and Y-axes results. If the panel 66 were fixed to a structural support member by a mechanical fastener, such as a bolt located at the corners 78, it would still be able to deform in both the X- and Y-axes without the overall shape changing. The edge corrugations 72 and 74 cooperate to allow flexibility along the Y-axis, while edge corrugations 73 and 75 allow flexibility along the X-axis. This flexibility can be maintained even if additional fasteners are required to achieve the appropriate mechanical strength.

Figure 10:
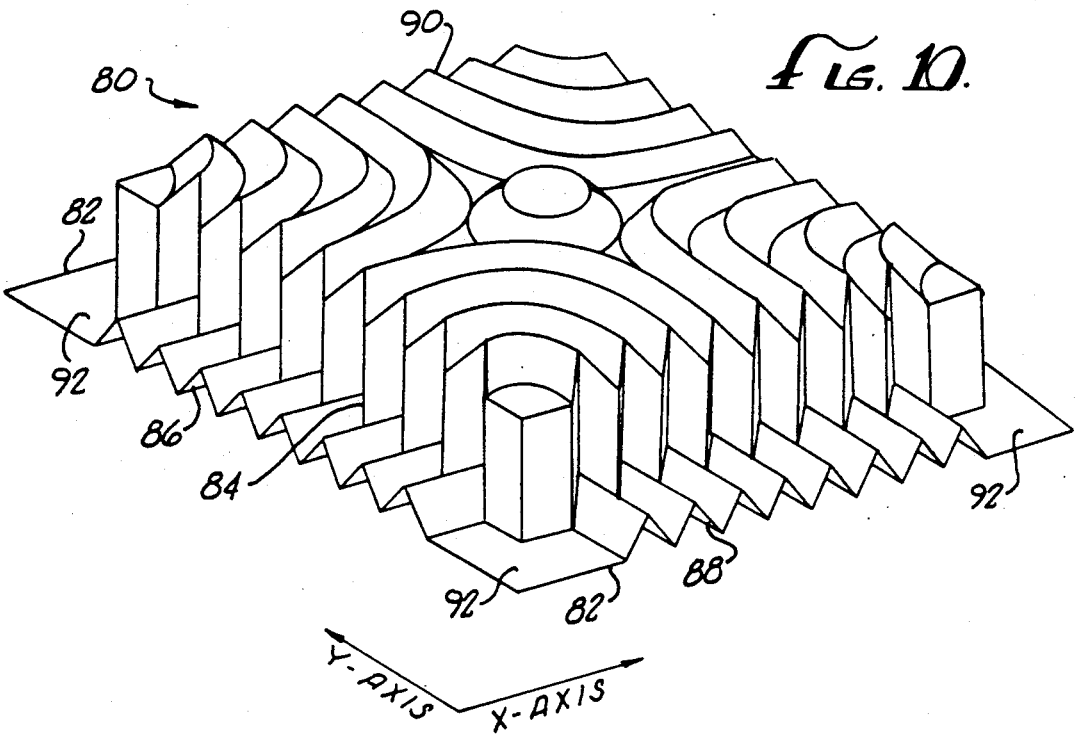
FIG. 10 is a perspective view of yet another embodiment of a bidirectional panel.

FIG. 10 shows yet another embodiment having similar bidirectional flexibility. In this embodiment, the panel 80 has edge portions 82 and a body portion 84 similar to the bidirectional panel 65, with corners 92 that can be mechanically fastened to a support structure. The edge portions 82 have corrugations 86 and 88 which allow for flexibility of the panel along both the X- and Y- axes. The body portion 84 likewise has diagonal body corrugations 90 which allow for flexure along both the X- and Y- axes, except that the corrugations are curvilinear and do not all extend in the same direction.

The embodiments illustrated in FIGS. 8 and 10 are particularly useful when greater structural strength is needed in the panels. By having a mechanical fastening means, such as bolts located along the edges and at the panel corners it is possible to obtain greater structural strength than by the panels attached to the structural support member as illustrated in FIG. 4.

Figure 11:
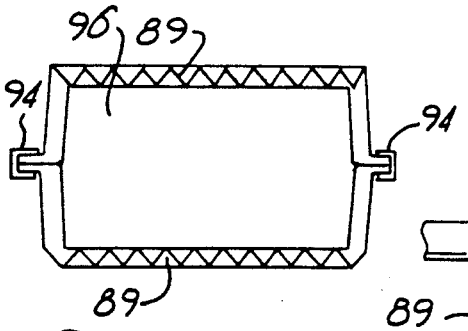
FIG. 11 is a side view of a particular mounting method of an adapted panel of FIG. 8.

FIG. 11 illustrates the bidirectional panel installed to create a "glass brick" effect. Due to the previously described asymmetry of the edge corrugation, the edge corrugations of two panels can fit or rest together when two panels are placed back-to-back and be placed in a channel 94. The body corrugations 89 disturb the light traveling through the body portion such that images cannot clearly be seen through the corrugations, but light will travel through—the same effect as a glass brick. The mounting configuration in FIG. 11 also has heat insulating benefits from the fact that the combined panels form a substantially closed air pocket 96. The mounting configuration in FIG. 11 also has advantageous sound absorbing properties.

Figure 12:
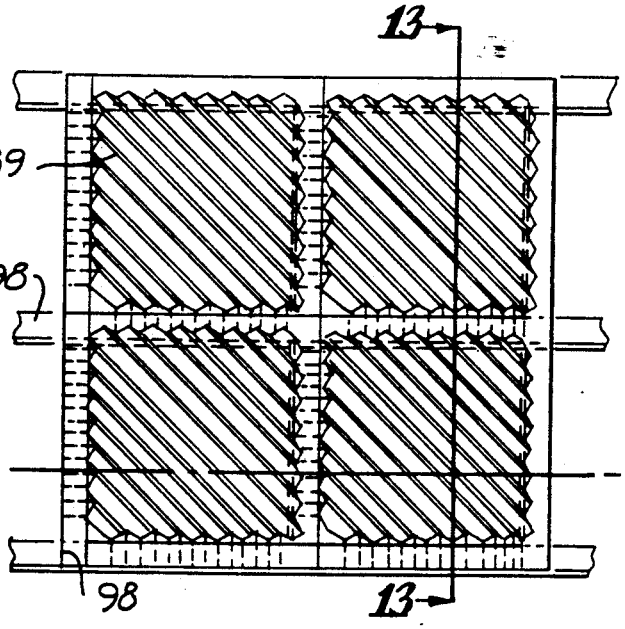
FIG. 12 is a top view of yet another mounting method for the panel of FIG. 8.
Figure 13:
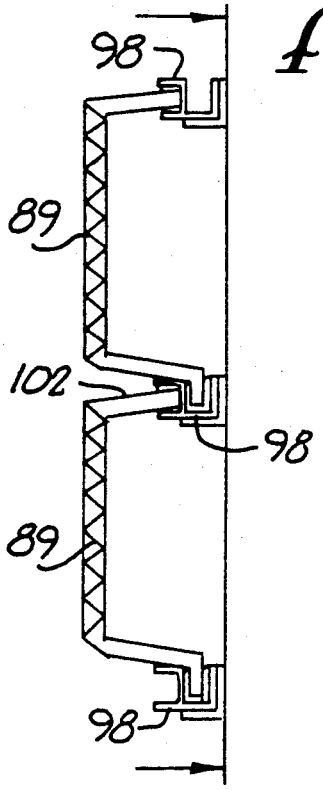
FIG. 13 is a side view of the mounting of FIG. 12.
Figure 14:
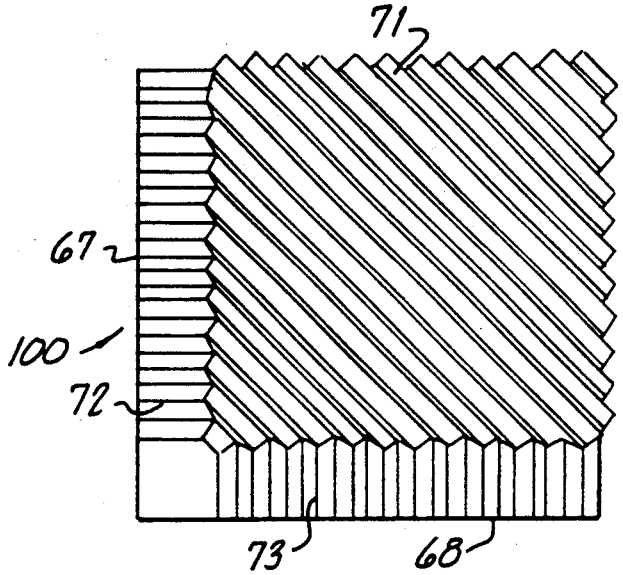
FIG. 14 is a top view of a modified form of the panel of FIG. 8 for use in the mounting of FIG. 11.
Figure 15:
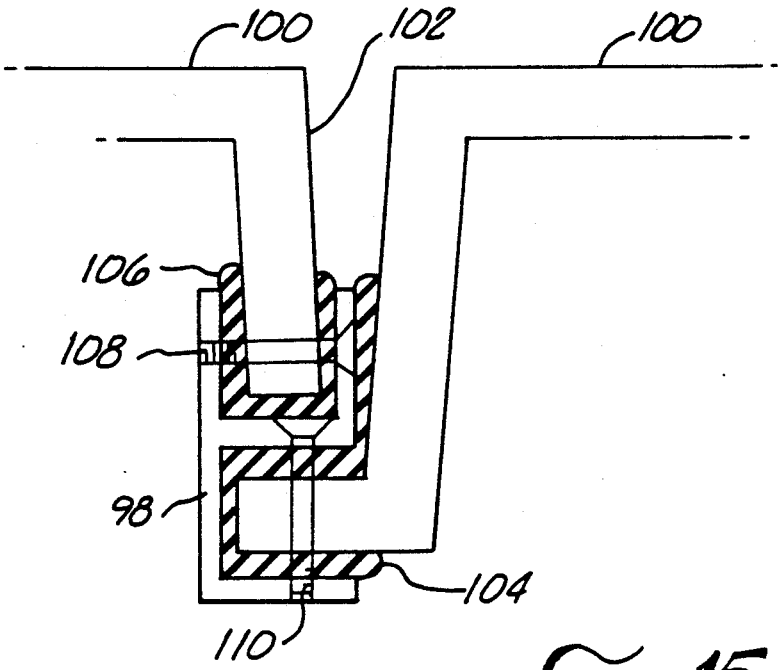
FIG. 15 is a side view of the orthogonal channel as used in the mounting of FIG. 11.

The bidirectional panel can also be installed to substantially eliminate the installation channel assembly from view as illustrated in FIG. 12. FIG. 13 shows the orthogonal channel 98 which retains adjacent bidirectional panels. A bidirectional panel 100 illustrated in FIG. 14 is adapted from the panel illustrated in FIG. 8, by removing edges 69 and 74. When the adapted panel 100 is mounted in the orthogonal channel 98, the panel side 102 will substantially cover the orthogonal channel. FIG. 15 illustrates the orthogonal channel showing gaskets 104 and 106 and fasteners 108 and 110.

It will, of course, be understood that modifications of the present invention will be apparent to others skilled in the art. Consequently, the scope of the present should not be limited by the particular embodiments described above but should be defined only by the claims put forth below and equivalents thereof.

I claim:

1. An adaptive cover panel comprising a body portion of generally conical configuration having radially-directed body corrugations formed therein, an edge portion adjacent said body portion including triangularly shaped radial edge corrugations formed therein, and a side portion adjacent said edge portion having side corrugations formed therein, wherein said body corrugations are intercorrugated with said edge corrugations, and said edge corrugations are intercorrugated with said side corrugations.

2. The adaptive cover panel of claim 1 wherein said radially-directed body corrugations originate from a point below the center of the conical body portion.

3. The adaptive cover panel of claim 1 wherein said side portion and said side corrugations are oriented perpendicular to the plane of the circumference of the cover panel.

4. The adaptive cover panel of claim 1 wherein said side portion and said side corrugations are oriented at an angle less than perpendicular to the plane of the circumference of the cover panel.

5. An architectural cover panel comprising a body portion having body corrugations formed therein, the periphery of said body portion having at least two edge portions adjacent thereto, each of said edge portions having edge corrugations formed therein, wherein the edge corrugations of at least one edge portion are formed asymmetrically with respect to the edge corrugations of another edge portion, and wherein said body corrugations are directed diagonally to said edge portions.

6. An architectural cover panel comprising a body portion having body corrugations formed therein, the periphery of said body portion having a first pair of parallel spaced-apart edge portions adjacent thereto, said first pair of edge portions having edge corrugations formed therein, the edge corrugations of one edge portion in said first pair being formed asymmetrically with respect to the edge corrugations of the other edge portion in said first pair, and the periphery of said body portion further having a second pair of parallel spaced apart edge portions adjacent thereto, said second pair of edge portions perpendicular to said first pair of edge portions, said second pair of edge portions having edge corrugations formed therein, the edge corrugations of one edge portion in said second pair being formed asymmetrically with respect to the edge corrugations of the other edge portion in said second pair, and wherein said body corrugations are directed diagonally to both said first pair of edge portions and said second pair of edge portions.

7. An architectural cover panel comprising a first panel and a second panel, said first panel comprising a body portion having body corrugations formed therein, the periphery of said body portion having at least two edge portions adjacent thereto, each of said edge portions having edge corrugations formed therein, the edge corrugations of at least one edge portion being formed asymmetrically with respect to the edge corrugations of another edge portion, said body portion raised relative to said edge portions;

said second panel comprising a body portion having body corrugations formed therein, the periphery of said body portion having at least two edge portions adjacent thereto, each of said edge portions having edge corrugations formed therein, the edge corrugations of at least one edge portion being formed asymmetrically with respect to the edge corrugations of another edge portion, said body portion raised relative to said edge portions; and means for retaining said first panel and said second panel in contiguous relationship whereby said body portions of said panels are spaced apart, and said first panel edge corrugations and said second panel edge corrugations are joined together.

8. A method for covering structural support members comprising attaching to said support members a plurality of architectural cover panels, each of said panels including a body portion having body corrugations formed therein, the periphery of said body portion having a first pair of parallel spaced-apart edge portions adjacent thereto, each of said edge portions having edge corrugations formed therein, the edge corrugations of one edge portion in the said first pair being formed asymmetrically with respect to the edge corrugations of the other edge portion in said first pair, and the periphery of said body portion further having a second pair of parallel spaced-apart edge portions perpendicular to said first pair of edge portions, each of said edge portions having edge corrugations formed therein, the edge corrugations of one edge portion in said second pair being formed asymmetrically with respect to the edge corrugations of the other edge portion in said second pair, and wherein said body corrugations are directed diagonally to said edge portion.

9. An architectural cover panel comprising a body portion having body corrugations formed therein, the periphery of said body portion having a first pair of parallel spaced-apart edge portions adjacent thereto, said first pair of edge portions having edge corrugations formed therein, said edge corrugations of one edge portion in said first pair being formed asymmetrically with respect to the edge corrugations of the other edge portion in said first pair, and the periphery of said body portion further having a second pair of parallel spaced-apart edge portions adjacent thereto, said second pair of edge portions perpendicular to said first pair of edge portions, said second pair of edge portions having edge corrugations formed therein, the edge corrugations of one edge portion in said second pair being formed asymmetrically with respect to the edge corrugations of the other edge portion in said second pair, and wherein said body corrugations are directed curvilinear to both said first pair of edge portions and said second pair of edge portions.

* * * * *